US006203689B1

(12) United States Patent
Kim et al.

(10) Patent No.: US 6,203,689 B1
(45) Date of Patent: Mar. 20, 2001

(54) ELECTROPOLISHING APPARATUS AND METHOD

(75) Inventors: Jeong Du Kim; Min Seog Choi, both of Taejun (KR)

(73) Assignee: Korea Advanced Institute Science and Technology, Taejun (KR)

( * ) Notice: Subject to any disclaimer, the term of this patent is extended or adjusted under 35 U.S.C. 154(b) by 0 days.

(21) Appl. No.: 09/159,212

(22) Filed: Sep. 23, 1998

(30) Foreign Application Priority Data

Sep. 23, 1997 (KR) ..... 97-48323

(51) Int. Cl.[7] ..... C25F 3/16; C25F 7/00

(52) U.S. Cl. ..... 205/652; 205/672; 205/686; 204/224 M; 204/DIG. 5

(58) Field of Search ..... 204/224 M, 284, 204/272, 217, DIG. 5; 205/665, 640, 672, 652, 654, 686, 662, 663, 661

(56) References Cited

U.S. PATENT DOCUMENTS 2,475,586 * 7/1949 Bartlett ..... 204/272 X
2,764,540 * 9/1956 Farin et al. ..... 205/672 X
3,183,176 * 5/1965 Schwartz, Jr. .
3,202,598 * 8/1965 Covington et al. ..... 204/224 M
3,449,226 * 6/1969 Williams ..... 204/224 M X
4,294,673 * 10/1981 Kimoto et al. ..... 205/663 X
4,752,367 * 6/1988 Vishnitsky ..... 204/224 M
4,826,582 * 5/1989 Lavalerie et al. ..... 204/224 M X
5,294,309 * 3/1994 Seimiya et al. ..... 205/663 X
5,958,195 * 9/1999 Lorincz et al. ..... 204/272 X

* cited by examiner

*Primary Examiner*—Donald R. Valentine
(74) *Attorney, Agent, or Firm*—Graybeal Jackson Haley LLP

(57) ABSTRACT

An electropolishing apparatus for polishing an inner face of a deep hole of an article comprises a support for holding an article so that the article is maintained to erect in an electrolytic bath, and an electrode to be inserted into a deep hole of the article. The electrode is a hollow member having a through hole formed longitudinally. Electrolyte is supplied into the through hole of the electrode from upside. The electrolyte flows through the through hole of the electrode, a gap between the lower end of the electrode and the bottom of the hole, and another gap to be between an outer face of the electrode and an inner face of the hole. A plurality of removers consisting of nonwoven fabric may be fixed around the electrode. The support and the article rotate, while the electrode moves up and down. Furthermore, a plurality of magnets may be arranged around the article so that a magnetic field is formed in a zone including the article. A body in which the magnet are embedded may be translated with the electrode to move up and down throughout the length of the article.

3 Claims, 4 Drawing Sheets

ELECTROPOLISHING APPARATUS AND METHOD

TECHNICAL FIELD OF THE INVENTION

This invention relates to an electropolishing apparatus and method, more particularly, the electropolishing apparatus and method for precisely and smoothly polishing an inner face of a deep hole in an article with any operation mark left.

BACKGROUND OF THE INVENTION

Generally, polishing a surface of an article is conducted by a mechanical polishing method in which the surface is abraded by a mechanical force or a physical force, by an electropolishing method in which the surface is electrochemically eroded.

In a representative mechanical polishing, a surface of an article is abraded by an abrasive stone. Such a method can not be applied to polishing an inner face of a hole having a small diameter so that an abrasive stone can not get into the hole. Moreover, there may be left scratches by crystalline particles in the abrasive stone, thermal strain due to high temperature during abrasion, and debris on the face after finishing to polish.

Although the electropolishing method does not involve problems related to scratches and thermal strain, bubbles generated during electrochemical reaction may become attached to the face to be polished to hinder electrolysis, whereby pits are left on the face after finishing to a polish. This problem is serious in an inner face of a deep hole. Moreover, in the case that the face to be polished is coated with the resultant from electrolysis, reaction rate is lowered, whereby the time taken to polish lengthens.

SUMMARY OF THE INVENTION

Therefore, this invention is to propose an electropolishing apparatus to polish an inner face of a deep hole by electropolishing with no pit left.

Furthermore, this invention is intended to promote electrochemical reaction in electrolysis by removing the resultant coated on the face to be polished.

According to an aspect of this invention, an electropolishing apparatus for polishing an inner face of a deep hole of an article is provided. The apparatus comprises a support for holding the article with the hole opened upward, an electrode adapted for insertion into the hole, and flow guiding means for flowing electrolyte up along the inner face of the hole.

The flow guiding means may be formed with a through hole drilled in the electrode longitudinally, and a gap adapted to be between an outer face of the electrode and the inner face of the hole.

The apparatus may further comprise a plurality of removers fixed on a outer face of the electrode to remove an electrolysis coat on the inner face of the hole, said electrode adapted for moving up and down in the hole, and said support adapted for rotating the article held thereon.

The apparatus may further comprise a plurality of magnets arranged around the article to form a magnetic field in a zone including the article.

The magnet may move up and down throughout the length of the article.

According to another aspect of this invention, an electropolishing method for polishing an inner face of a deep hole of an article is provided. The method comprises steps for holding the article with the hole opened upward in an electrolytic bath, supplying electric energy through an electrode adapted for insertion into the hole, and flowing electrolyte up along the inner face of the hole.

In the flowing step, the electrolyte flows through a through hole drilled in the electrode longitudinally, and a gap adapted to be between an outer face of the electrode and the inner face of the hole.

The method may further comprise a step for removing an electrolysis coat on the inner face of the hole.

The method may further comprise a step for forming a magnetic field in a zone including the article using a plurality of magnets arranged around the article.

Other advantages and features of the present invention will become apparent from the following description, including the drawings and claims.

DESCRIPTION OF THE PREFERRED EMBODIMENTS

Hereinafter, preferred embodiments of electropolishing apparatus according to this invention are explained referring appended drawings.

Figure 1:
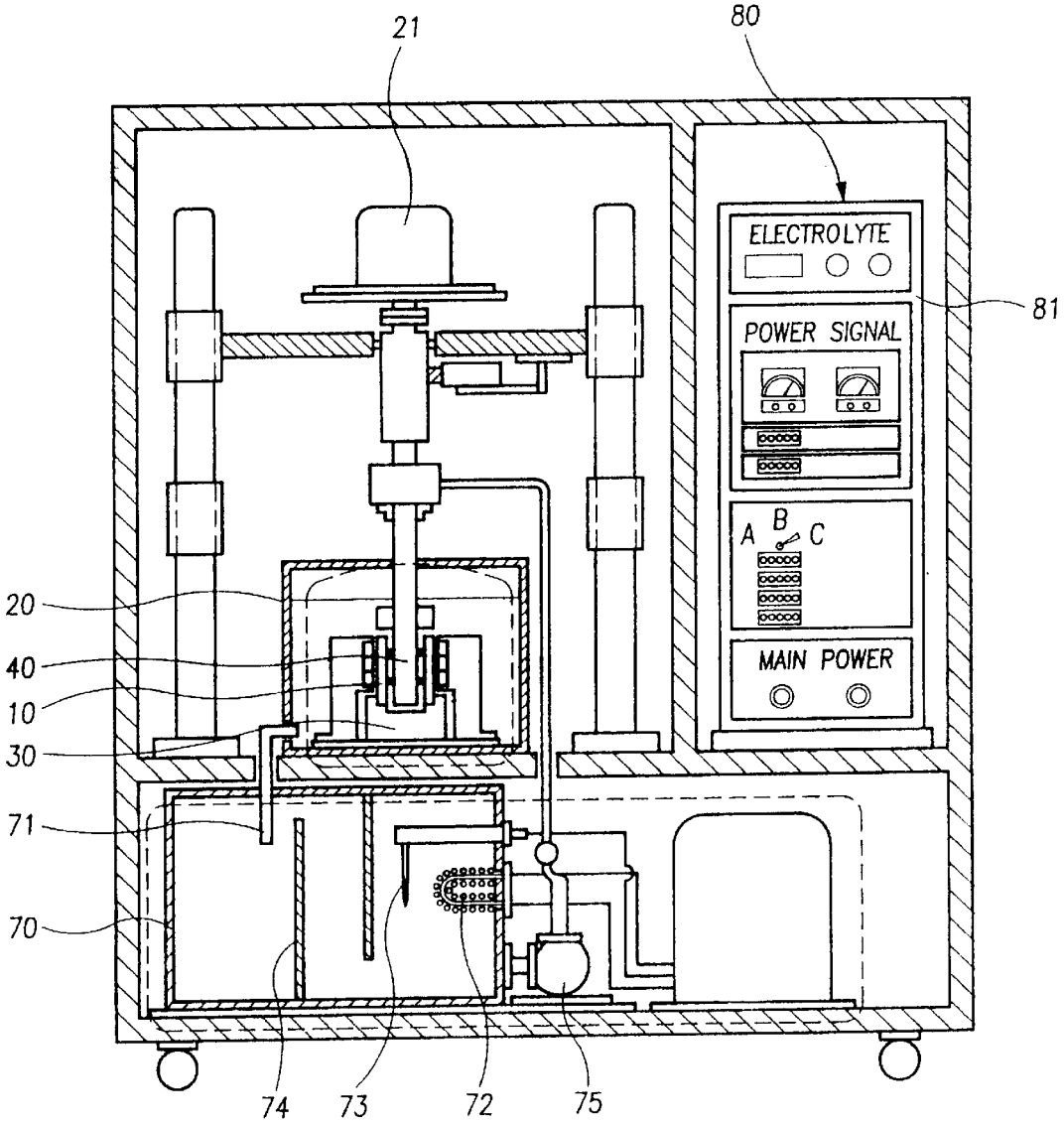
FIG. 1 shows a schematic view of general constituents of an electropolishing apparatus according to this invention for exemplifying arrangement of the constituents.
Figure 2:
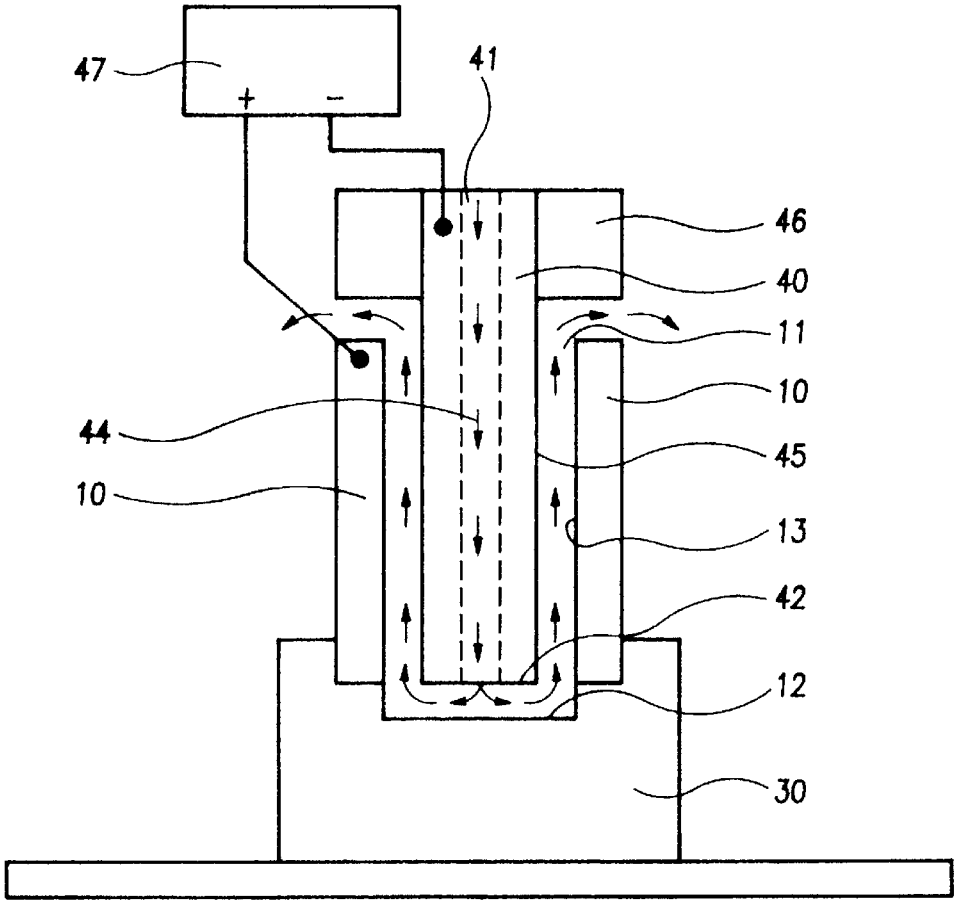
FIG. 2 shows a schematic view of arrangement of an article to be polished, an electrode and a support for the article in an electrolytic bath of an embodiment of the electropolishing apparatus according to this invention for explaining flow of electrolyte.

As shown in FIG. 1 and FIG. 2, the electropolishing apparatus according to a preferred embodiment of this invention comprises a support 30 for holding an article 10 so that the article 10 is maintained erect in an electrolytic bath 20, and an electrode 40 to be inserted into a deep hole 11 of the article 10, which is to be polished. The electrode 40 is a hollow member having a through hole 41 formed longitudinally. In this embodiment, the electrode 40 acts as a cathode, while the article 10 acts as an anode.

As shown in FIG. 2, the article 10 is maintained on support 30 with the hole 11 opened upward during polishing. The electrode 40 inserted into the hole 11 from upside is maintained with a lower end 42 of the electrode 40 spaced from a bottom 12 of the hole 11.

Electrolyte 44 is supplied into the through hole 41 of the electrode 40 from upside. The electrolyte 44 flows through the hole 41 of the electrode 40, a gap between the lower end of the electrode 40 and the bottom 12 of the hole 11, and another gap adapted to be between an outer face 45 of the electrode 40 and an inner face 13 of the hole 11 as shown in FIG. 2.

Pressure and flow rate of the electrolyte 44 should be controlled to push up bubbles the gap between the outer face 45 of the electrode 40 and the inner face 13 of the hole 11.

Preferably, a flow resistance 46 is provided around an upper portion of the electrode 40 to resist flow of the electrolyte 44 flowing out of the hole 11. The flow resistance 46 makes the flow in the gap adapted to be between the outer face 45 of the electrode 40 and the inner face 13 of the hole 11 to be steady flow under a constant prevailing pressure. The flow resistance 46 is an annular member that is forcedly fitted around the electrode 40 so that the member displaced upwardly or downwardly to control its position on the electrode 40 only by a force greater than a given force.

The support 30 and/or the electrode 40 are preferred to be adaptable parts that are changeable to correspond to the size of the article 10. If the hole 11 of the article 10 is a bottomless hole, it is preferred to provide a recess corresponding to the diameter of the hole 11 of the article on the support 30.

Another embodiment of this invention, a plurality of removers 51 consisting of anything of nonwoven fabric, buff, abrasive stone and sponge are fixed around the electrode 40. In this embodiment, the support 30 and the article 10 rotate, while the electrode 40 moves up and down. Rotation of the support 30 and movement of the electrode 40 are performed by desirable transmitting trains from a motor 21 mounted on the electrolytic bath 20 as shown in FIG. 1.

As the support 30 rotates and the electrode 40 moves, the removers 51 rub off an electrolysis coat on the inner face 13 of the hole 11 of the article 10. It is preferred that the removers 51 clean out only coatings without leaving scratches on the inner face 13 of the hole 11 of the article 10. Preferably, the removers 51 are arranged in two or three rows, while each row comprises two or three removers.

Figure 3:
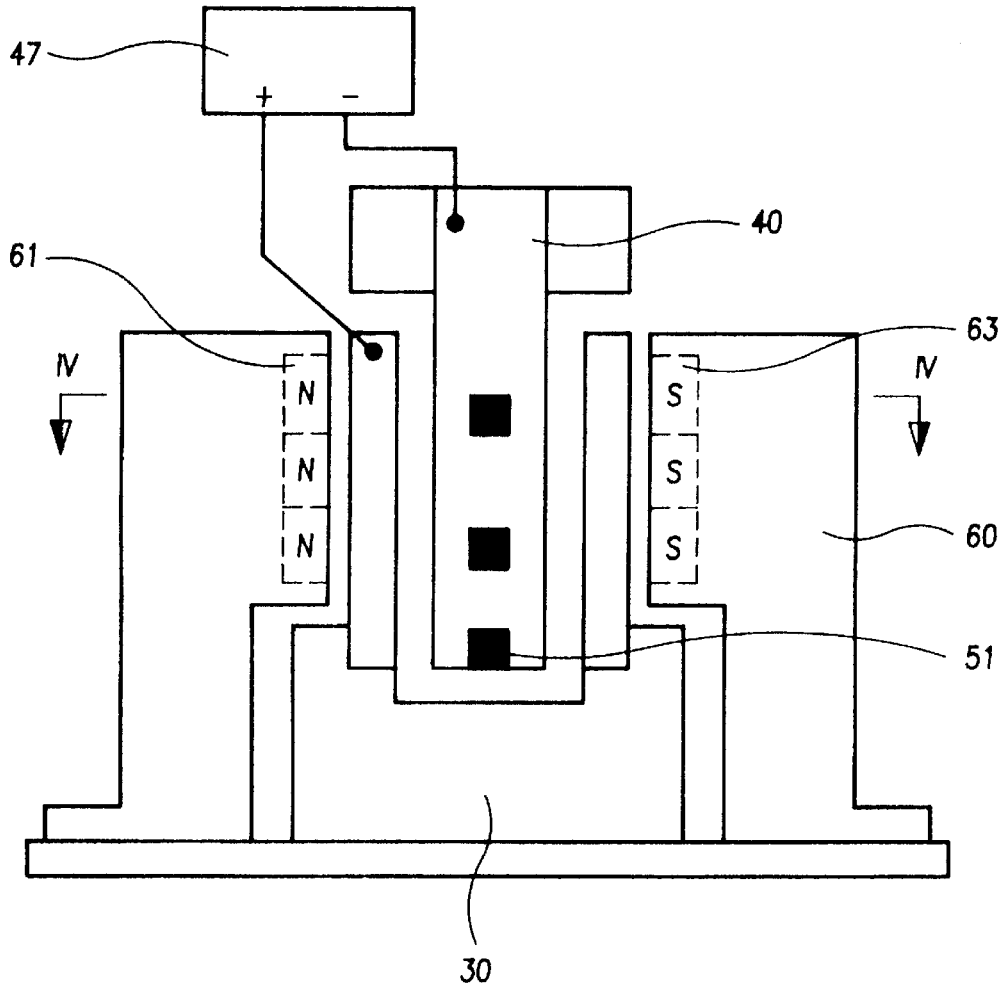
FIG. 3 shows a schematic view of a scrubber and a magnet of another embodiment of the electropolishing apparatus according to this invention.
Figure 4:
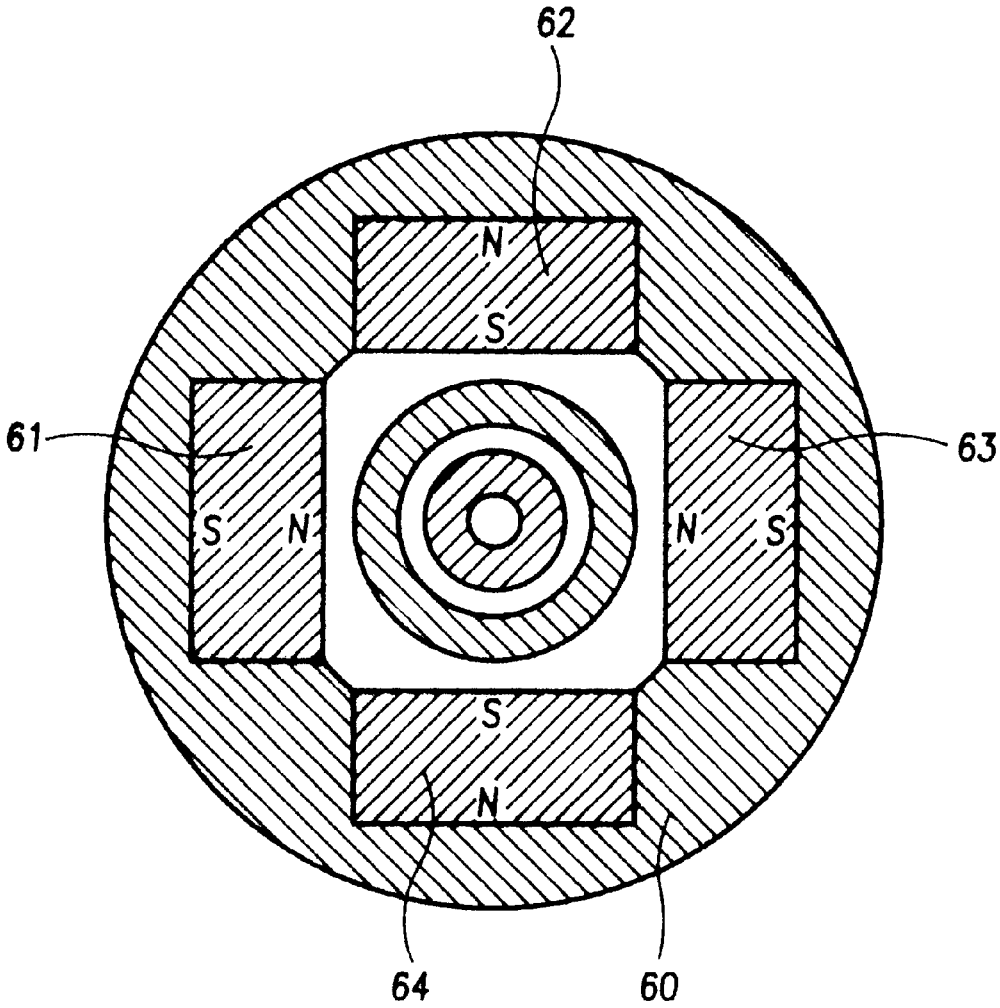
FIG. 4 shows a sectional view taken along line IV—IV in FIG. 3 for explaining arrangement of the magnets.

Furthermore, a plurality of magnets 61, 62, 63 and 64 are arranged around the article 10 so that a magnetic field is formed in a zone including the article 10 as shown in FIG. 3 and FIG. 4. The magnetic field promotes electrolysis rate by activating electrolyzed ions by Lorentz' effect. The magnets 61, 62, 63 and 64 may be a natural magnet or an electric magnet.

In this embodiment shown in FIG. 3, the magnets 61, 62, 63 and 64 are formed in three layers, while magnets of each layer are arranged as shown in FIG. 4. Body 60 in which the magnets 61, 62, 63 and 64 are embedded is translated with the electrode 40 to move up and down throughout the length of the article 10.

Moreover, it is preferred that a reservoir 70 for reserving electrolyte is provided as shown in FIG. 1. The reservoir 70 is arranged under the electrolytic bath 20 to receive electrolyte influenced from the electrolytic bath 20 through a pipeline 71. The pipeline 71 is preferably installed at a lower portion of the electrolytic bath 20 so that debris settled to the electrolytic bath 20 are flowed out along with the electrolyte. In this case, a valve (not shown) is provided in the pipeline 71 to control flow rate of the electrolyte so that the level of the electrolyte in the electrolytic bath 20 is maintained constantly.

Furthermore, a heater 72 and a temperature sensor 73 are provided in the reservoir 70 to control the temperature of the electrolyte.

It is preferred that a partition wall 74 acting as a filter for filtrating debris flowed through the pipeline 71 is provided in the reservoir 70.

The electrolyte reserved in the reservoir 70 is pumped by a pump 75 and supplied into the through hole 41 of the electrode 40.

Both operational constituents and electrolysis conditions are controlled through control knobs 80 integrated on a control panel 81.

Although this invention is explained based on preferred embodiments shown in the drawings, the embodiments are not for limiting but exemplifying this invention. For example, arrangement of magnetic polarities may have an order, N-N-S-S unlike the order, N-S-N-S shown in FIG. 4.

As the electropolishing apparatus according to this invention, an inner face of a deep hole of an article can be easily and precisely polished with no pits left, while promoting electrolysis rate to shorten the required time.

It will be apparent to a skilled man in this technical field that alterations, changes or modulations from the aforementioned embodiments can be obtained without departing from technical idea of this invention.

What is claimed is:

1. An electropolishing apparatus for polishing an inner face of a deep hole of an article comprising:

a support for holding the article with the hole opening facing upward;

an electrode adapted for insertion into the hole;

flow guiding means for directing up electrolyte along the inner face of the hole, said flow guiding means comprising a through hole disposed in the electrode longitudinally, said flow guiding means adapted to form a gap between an outer face of the electrode and the inner face of the hole;

a plurality of magnets adapted for arrangement around the article for forming a magnetic field in a zone including the article; and a plurality of removers fixed on a outer face of the electrode to remove an electrolysis coat from the inner face of the hole, said electrode adapted for moving up and down in the hole, and said support adapted for rotating the article held thereon.

2. The electropolishing apparatus according to claim 1, wherein said magnets are adapted for moving up and down throughout the length of the article.

3. An electropolishing method for polishing an inner face of a deep hole of an article comprising steps for:

holding the article with the hole facing upward in an electrolytic bath;

supplying electric energy through an electrode adapted for insertion into the hole;

forming a magnetic field in a zone including the article using a plurality of magnets arranged around the article;

directing an electrolyte through a through hole drilled in the electrode longitudinally and through a gap located between an outer face of the electrode and the inner face of the hole; and removing an electrolysis coat from the inner face of the hole.

* * * * *